US008087423B2

(12) United States Patent
Knipschild

(10) Patent No.: US 8,087,423 B2
(45) Date of Patent: Jan. 3, 2012

(54) APPARATUS FOR PROVIDING PROTECTION AGAINST THE SUN

(76) Inventor: Christina Knipschild, Bromskirchen (DE)

( * ) Notice: Subject to any disclaimer, the term of this patent is extended or adjusted under 35 U.S.C. 154(b) by 0 days.

(21) Appl. No.: 12/300,770

(22) PCT Filed: May 22, 2007

(86) PCT No.: PCT/EP2007/004510

§ 371 (c)(1),
(2), (4) Date: Nov. 14, 2008

(87) PCT Pub. No.: WO2007/137730

PCT Pub. Date: Dec. 6, 2007

(65) Prior Publication Data

US 2009/0114260 A1 May 7, 2009

(30) Foreign Application Priority Data

May 26, 2006 (DE) ..... 10 2006 024 488

(51) Int. Cl.
*E04H 15/40* (2006.01)

(52) U.S. Cl. ..... 135/125; 135/116; 135/117

(58) Field of Classification Search ..... 135/125, 135/120.1, 120.3, 116, 127, 124, 906, 117, 135/136, 137, 138
See application file for complete search history.

(56) References Cited

U.S. PATENT DOCUMENTS

| | | | | |
|---|---|---|---|---|
| 3,223,098 | A * | 12/1965 | Dole, Jr. | 135/126 |
| 4,075,723 | A * | 2/1978 | Bareis et al. | 114/361 |
| 4,433,700 | A * | 2/1984 | Dohet | 135/97 |
| 4,709,718 | A | 12/1987 | Nichols | |
| 4,825,892 | A | 5/1989 | Norman | |
| 4,877,044 | A * | 10/1989 | Cantwell et al. | 135/127 |
| 5,067,505 | A * | 11/1991 | Cantwell et al. | 135/125 |
| 5,595,203 | A * | 1/1997 | Espinosa | 135/124 |
| 5,609,177 | A * | 3/1997 | Iver | 135/130 |
| 5,927,311 | A * | 7/1999 | Jager | 135/124 |
| 6,892,742 | B2 * | 5/2005 | Wang | 135/125 |
| 7,673,642 | B1 * | 3/2010 | Shires | 135/136 |
| 7,841,356 | B2 * | 11/2010 | Shires | 135/136 |
| 2002/0020439 | A1 * | 2/2002 | Tate | 135/124 |
| 2006/0037274 | A1 * | 2/2006 | Perez et al. | 52/646 |

FOREIGN PATENT DOCUMENTS

| | | | |
|---|---|---|---|
| DE | 2319796 | A1 | 10/1974 |
| WO | WO96/18789 | A | 6/1996 |

* cited by examiner

*Primary Examiner* — Noah Chandler Hawk

(74) *Attorney, Agent, or Firm* — Kilpatrick Townsend & Stockton LLP

(57) ABSTRACT

The invention relates to an apparatus for providing protection against the sun, said apparatus including a rod assembly (2) and a fabric (3) or the like that is stretchable over said rod assembly, wherein the rod assembly (2) includes two rods (4), which intersect, are each resiliently bendable and can be braced in an arched manner by inserting the rod ends (5) into eyelets (7) at the ends (8) of two intersecting webbing straps (9) extending over a floor (27), over which the rods (4) can arch, with the rod ends (5) being subjected to tensile stressing, and which are pretensionable by inserting the rod ends (5) into straps (24) on a bottom longitudinal edge (23) of the fabric (3) for stretching the fabric (3) over the rod assembly (2), wherein a cross-strut (19) is supported in the intersection region (10) of the rods (4) to support the fabric (3).

16 Claims, 6 Drawing Sheets

Fig. 4
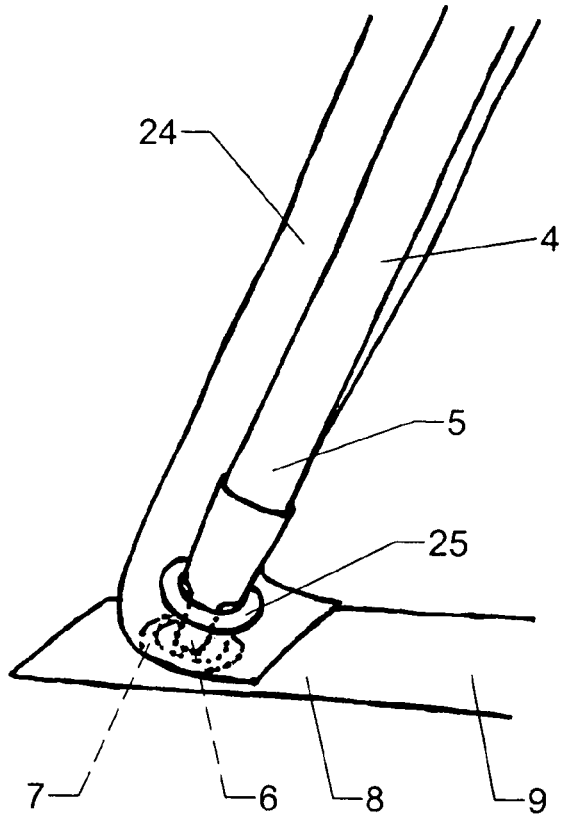
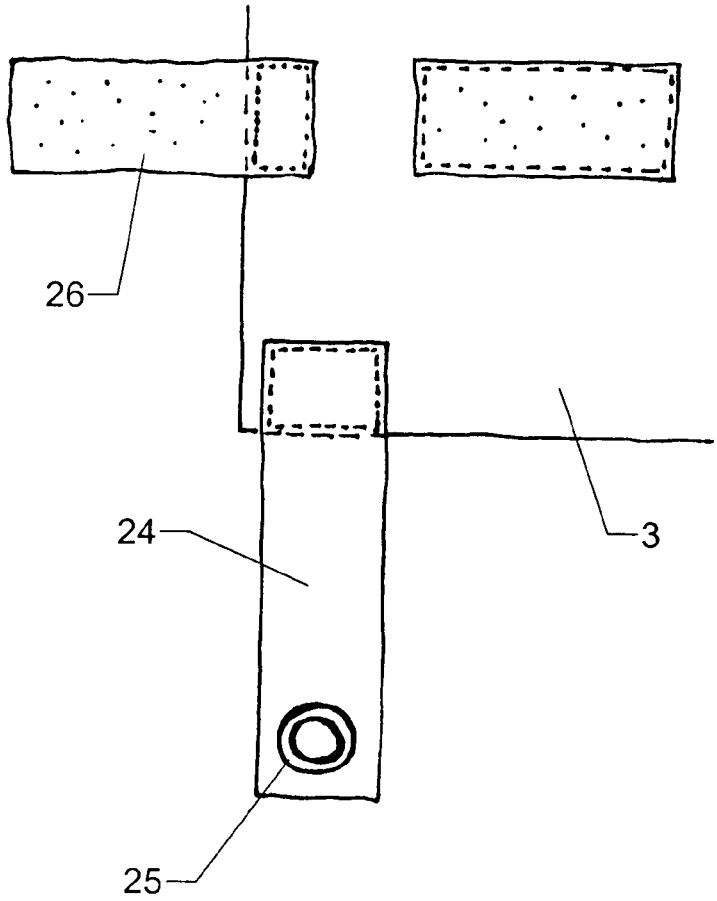
Fig. 5

Fig. 6
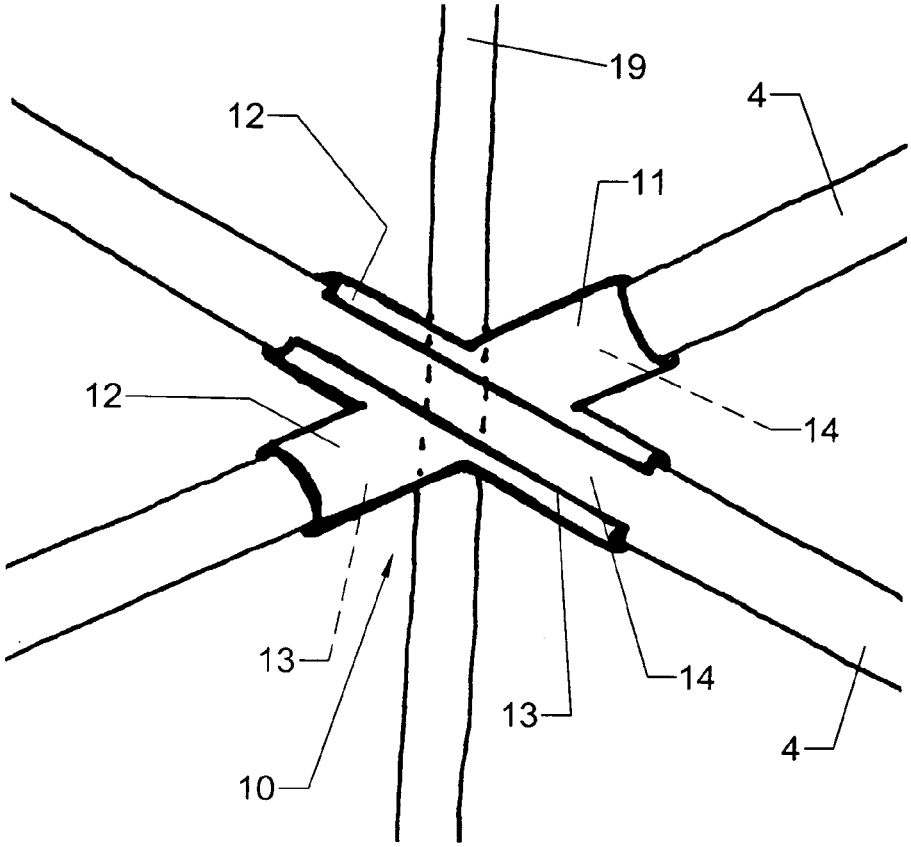
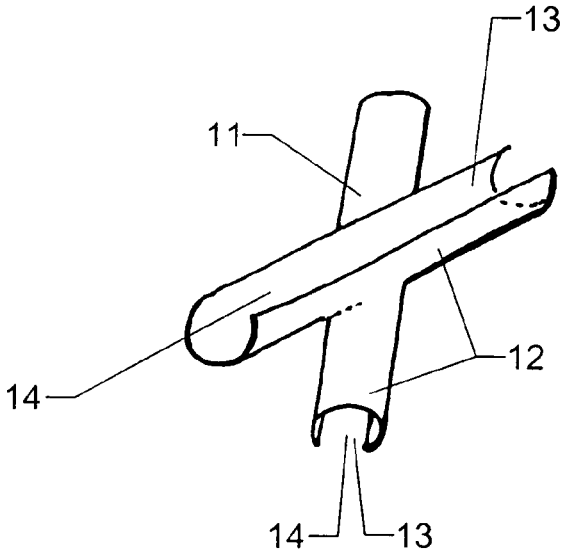
Fig. 7

Fig. 8
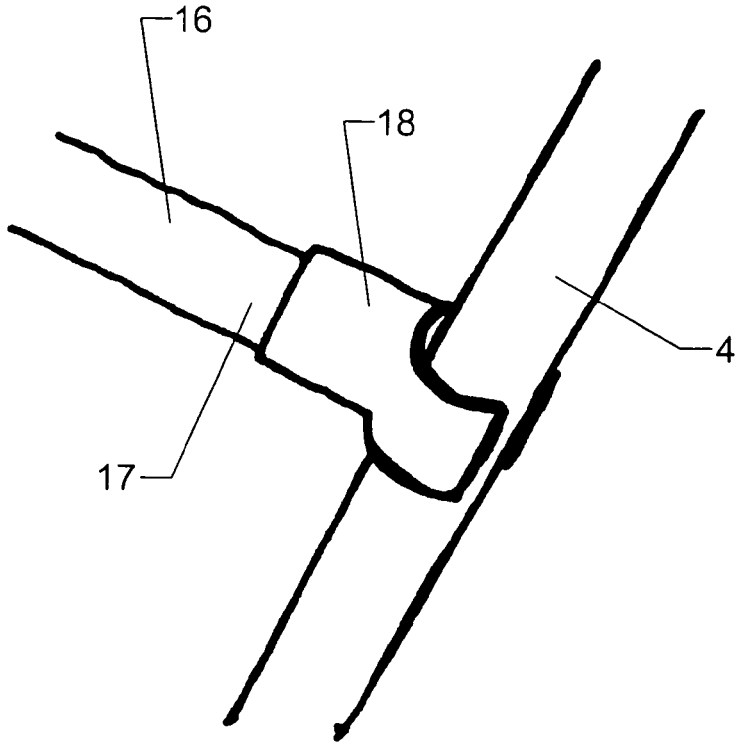
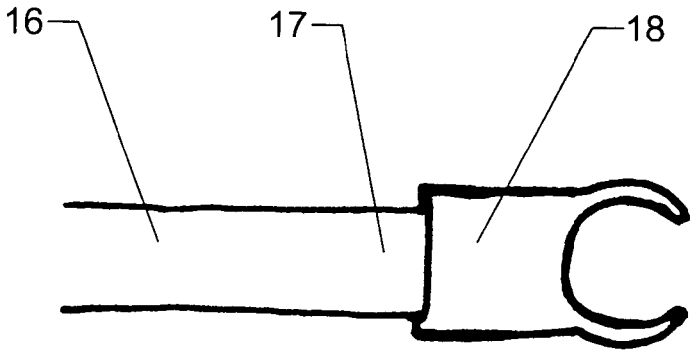
Fig. 9

APPARATUS FOR PROVIDING PROTECTION AGAINST THE SUN

The invention relates to an apparatus for providing protection against the sun, said apparatus including a rod assembly and a fabric or the like that is stretchable over said rod assembly.

Such types of apparatuses for providing protection against the sun are known, for example, in the form of sunshades or parasols. If sunshades or parasols are used on beaches, grass or other areas, they preferably have to be secured in the ground, there also being the possibility of using a sunshade or parasol stand. A great disadvantage of sunshades or parasols, however, is that they are highly susceptible to the wind, which, at worst, can result in the sunshades or parasols becoming damaged. In addition, due to their nature, sunshades or parasols do not provide optimum shade for the body.

Shelters such as those described in CH 675 446 A5 and U.S. Pat. No. 5,546,971 are also known, and these do provide better shade; however, due to their size and the relatively time-consuming and costly assembly, requiring several people in the majority of cases, they are hardly suitable for short-term use. In addition, these shelters have to be secured by means of pegs, and even then are not particularly stable. The same is applicable to tents, such as described in U.S. Pat. No. 3,223,098.

Also known are so-called beach shelters, such as are described in GB 2 308 393 A; these, however, do not really act as protection against the sun. Rathermore, said beach shelters are to be seen as providing protection against the wind, thus having to be fixed very securely against the wind by means of guying or by being weighted down. Said beach shelters only provide protection against the sun for children, if at all, and the area inside the beach shelter does become very hot.

It is possible to change the position of the beach shelter but the guying and weighting down makes this very awkward and involved.

Consequently, it is the object of the invention to create an apparatus of the specified generic type for providing protection against the sun, said apparatus, on the one hand, providing optimum protection against the sun and, on the other hand, providing a stable footing even in very strong winds, the assembly of the apparatus for providing protection against the sun also being very simple and rapid to accomplish.

This object is achieved according to the invention through an apparatus for providing protection against the sun with the characteristic features of claim 1.

Expedient further developments of the invention are characterized in the subclaims.

The apparatus according to the invention for providing protection against the sun distinguishes itself, among other things, by being easy to set up. Thus, the amateur finds it very simple to set up the dismantled apparatus for providing protection against the sun reliably and rapidly at the respective site, the individual parts of said apparatus preferably being accommodated in a small sack. It is also relatively simple to move the position of the apparatus for providing protection against the sun, as in this case no guying is necessary.

In addition, the apparatus for providing protection against the sun distinguishes itself by being not particularly susceptible to the wind. Among other things, this is due to the webbing straps that are situated on the ground in conjunction with the curved individual rods.

As the apparatus for providing protection against the sun is highly air-permeable, it does not become overheated, an open view in all directions also being afforded.

Additional advantages of the invention can be gathered from the following description by way of an exemplary embodiment that reproduces the invention and is represented in the drawing, in which:

FIG. 4 shows an enlarged detail of a foot region.

FIG. 5 shows an enlarged detail of a corner region of the fabric.

FIG. 6 shows an enlarged detail at the intersection region of the individual rods, viewed from below.

FIG. 7 shows a simplified view in perspective of the molded part for the intersection region of the individual rods.

FIG. 8 shows an enlarged detail in perspective of one end of a connecting strut at an individual rod.

FIG. 9 shows an enlarged detail of one end of a connecting strut.

The apparatus 1 for providing protection against the sun represented in the figures essentially comprises a rod assembly 2 and a fabric 3 that is stretchable over said rod assembly.

Figure 3:
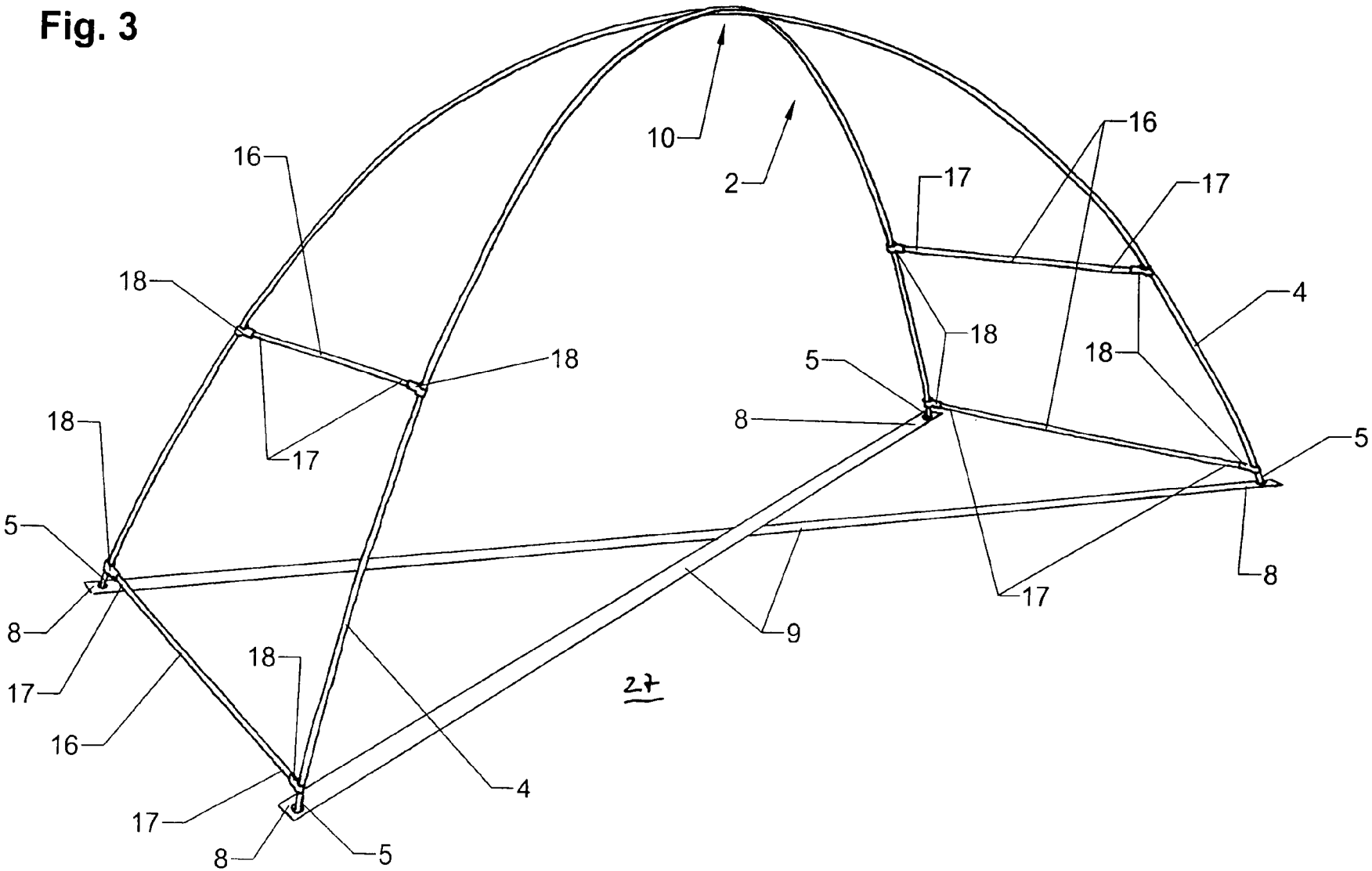
FIG. 3 shows a view in perspective of the apparatus for providing protection against the sun without any fabric.

The rod assembly 2, in turn, essentially comprises two intersecting, resilient individual rods 4, which, in the position of use, are inserted by means of tips 6 that are provided at their ends 5 into eyelets 7 at the ends 8 of two webbing straps 9 that intersect on the ground (see more especially FIGS. 1, 3 and 4), the rod assembly 2 or the individual rods 4 being curved in an arched manner (see FIG. 3). So that the individual rods 4 can be transported about more easily, they each comprise a multiplicity of rod parts that can be fitted together, two adjacent rod parts being interconnected by means of preferably resilient-ties or the like (not shown).

To make the individual rods 4 secure, said rods are interconnected in the intersection region 10. For this purpose, a molded part 11, preferably produced from plastics material, can be provided in the intersection region 10 of the individual rods 4, said molded part comprising two intersecting tubular sections 12, continuous elongated slots 14 being provided in the open sides 13 of said tubular sections remote from one another. The molded part is clipped to the individual rods 4 by means of the elongated slots 14 (see FIGS. 6 and 7 in this respect).

To stabilize the apparatus 1 for providing protection against the sun even more, the two adjacent individual rods 4 on the narrow sides 15 of the apparatus 1 for providing protection against the sun are each retained by means of at least one connecting strut 16. In the exemplary embodiment shown here, there are two connecting struts 16 on each narrow side 15, the connecting strut 16 that is disposed higher up obviously being shorter than the lower connecting strut 16. The connecting struts 16 can be clipped onto the individual rods 4 by means of retaining elements 18 that are provided at the ends 17 of said connecting struts (see FIGS. 8 and 9 in this respect).

A cross-strut 19 is supported in the intersection region 10 of the individual rods 4 to support the fabric 3, said cross-strut preferably being connected to the individual rods 4 or to the molded part 11. This can be effected, for example, by means of ties attached to the cross-strut 19 or to the fabric 3, said ties then being bound around the individual rods 4 or around the molded part 11.

The cross-strut 19 can be inserted into pockets 20 (shown by the dash-dot lines in FIG. 2) on the lateral longitudinal edge 21 of the fabric 3 or can be sewn into a pocket 22 that extends from one longitudinal edge 21 of the fabric 3 to the other longitudinal edge 21 of the fabric 3.

The fabric 3 is retained by the tips 6 of the individual rods 4 by means of straps 24 with eyelets 25 provided on the bottom longitudinal edge 23 (see FIG. 4 also in this respect). Additional straps 26 on the lateral longitudinal edge 21 of the fabric 3 connect the fabric 3 to the individual rods 4 by means of touch-and-close fasteners (see FIG. 1 and FIG. 5).

As can be seen in the above description of the apparatus 1 for providing protection against the sun, the apparatus 1 can be very simply and rapidly erected. A secure footing for the assembled apparatus 1 is guaranteed at all times, it also being possible to accomplish a simple change in position very easily and very rapidly.

For transport or for storage purposes, following easy dismantling, the apparatus 1 according to the invention for providing protection against the sun can be very easily packed away to form a relatively small package, said small package also being very light on account of the relatively small number of individual parts and on account of the materials used.

It is also possible to change the fabric 3 on the apparatus 1 for providing protection against the sun without performing any special measures, that is to say if the fabric 3 is ripped or faulty, or should a new design be desired for the material of the fabric 3, just the fabric 3 can be changed in a simple and cost-effective manner.

Figure 1:
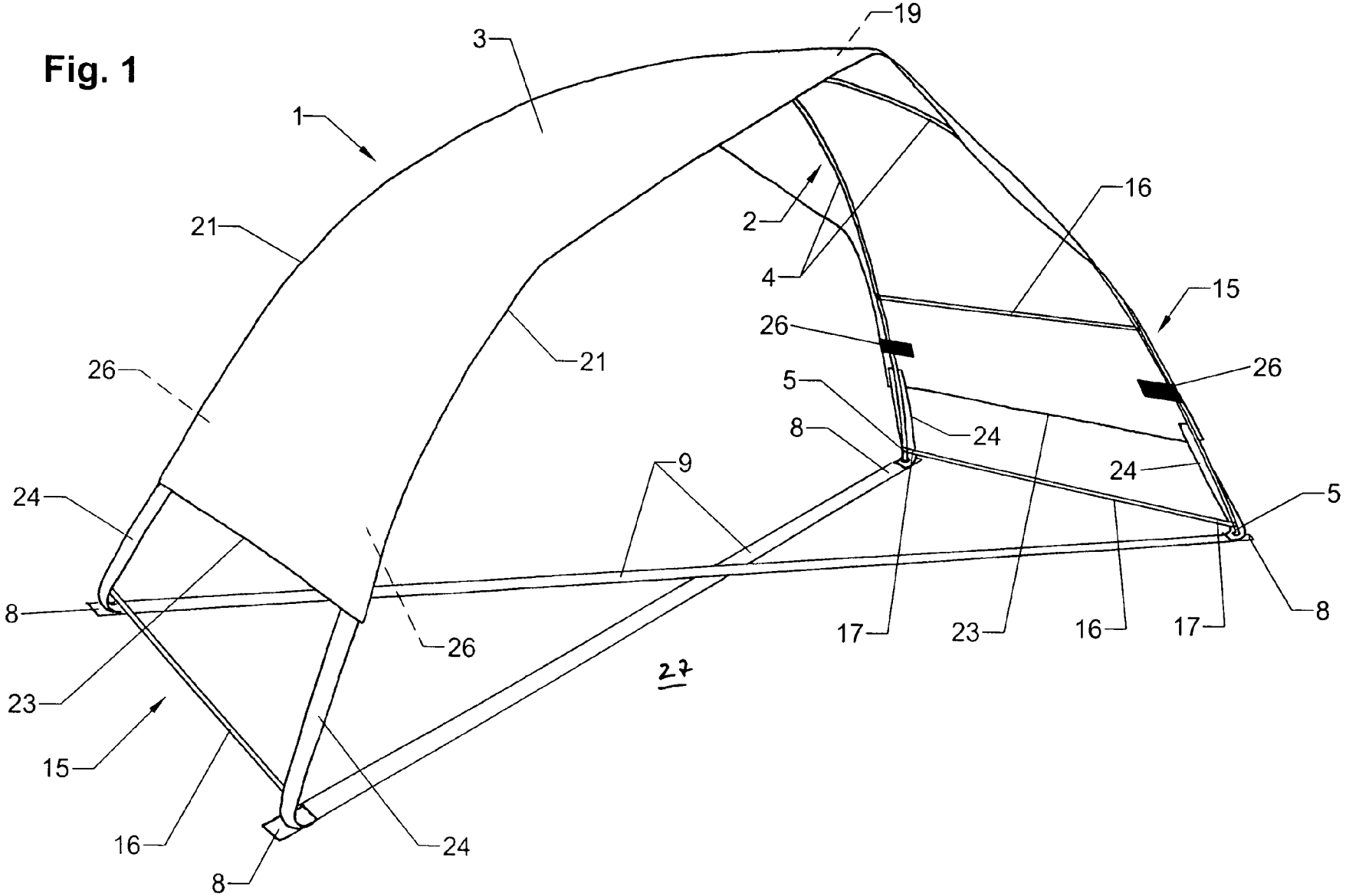
FIG. 1 shows a view in perspective of an apparatus for providing protection against the sun.

The apparatus 1 according to the invention for providing protection against the sun, as represented in the position of use in FIG. 1, can be erected as follows:

Apparatus 1 for providing protection against the sun comprises the rod assembly 2 and the fabric 3 that is stretchable over said rod assembly.

As is shown in FIG. 3, the rod assembly 2 includes two rods 4, which intersect, are each resiliently bendable and can be formed by individual rods comprising one or more parts. Said resiliently bendable rods 4 are braced in an arched manner by inserting the rod ends 5 into eyelets 7 (cf. FIG. 4) at the ends 8 of two intersecting webbing straps 9 extending over a floor 27, over which the rods 4 can arch, with the rod ends 5 being subjected to tensile stressing. The degree of curvature is variable over the length of the webbing straps 9, a length of the apparatus 1 for providing protection against the sun thereby also being adjustable. The floor 27 is preferably formed by a ground sheet, on which the apparatus 1 for providing protection against the sun is set up.

Figure 2:
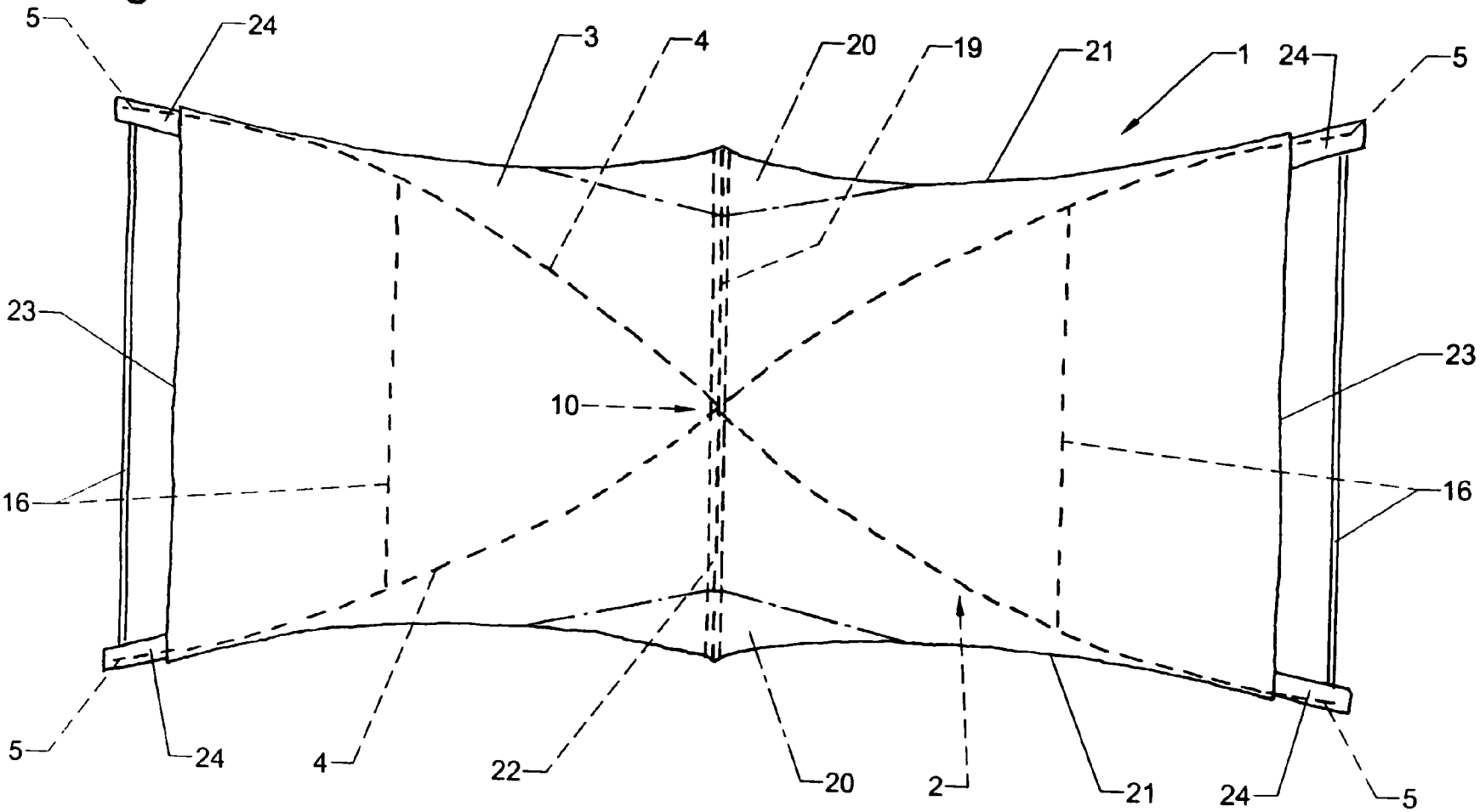
FIG. 2 shows a simplified top view of the apparatus for providing protection against the sun.

As is shown in FIG. 2, the resiliently bendable rods 4 are pretensioned (resiliently) by inserting the rod ends 5 into straps 24 on a bottom longitudinal edge 23 of the fabric 3 for stretching the fabric 3 over the rod assembly 2. This can be recognized by the easy double curvature of the resilient rods 4 that intersect in the intersection region 10. Each rod 4 is consequently longer than the diagonals of the substantially rectangular fabric 3, a compressing and expanding force thereby being exerted onto the fabric 3 and the fabric 3 thereby being stretched on the rod assembly 2. This prevents the fabric 3 fluttering on the rod assembly from flapping about. In addition, a fabric 3 stretched on the rod assembly 2 in this manner gives the rod assembly 2 additional stability, which means that the connecting struts 16 can also be dispensed with. Care must preferably be taken to ensure that the bottom longitudinal edge 23 of the fabric 3 is stretched, for which purpose it is possible to insert a tensioning strut into a seam on the longitudinal edge 23.

The fabric 3 is supported in the intersection region 10 of the rods 4 by means of a cross-strut 19 in order to secure the fabric 3 additionally at the summit of the curvature.

The intersection of the webbing straps 9 is preferably fixed in order to improve the alignment of the intersections one relative to the other.

In addition, the intersection region 10 of the rods 4 that are curved in an arched manner and the intersection of the webbing straps 9 are preferably disposed one above the other, thereby obtaining particular stability.

Finally, the intersections of the rod 4 and of the webbing straps 9 are preferably situated centrally between the respective ends 5 and 8.

The invention claimed is:

1. An apparatus for providing protection against the sun, said apparatus comprising a rod assembly, a fabric that is stretchable over said rod assembly, the fabric having two lateral edges and two bottom edges, and first and second ground strap segments, wherein the rod assembly includes two rods, with each rod having two ends, wherein the rods each intersect at only a single location to define an intersection region, are each resiliently bendable and can be braced in an arched manner by coupling the rod ends to ends of the first and second ground strap segments, with the rod ends being subjected to tensile stressing, and further comprising first and second tent strap segments extending from one of the bottom edges of the fabric and third and fourth tent strap segments extending from the other bottom edge of the fabric, with the first and second tent strap segments being coupled to the ends of the rods and the third and fourth tent strap segments being coupled to opposite ends of the rods, with the fabric being stretched over the rod assembly, wherein one of the rods is coupled to and extends diagonally across the fabric between the first tent strap segment and the third tent strap segment and the other rod is coupled to and extends diagonally across the fabric between the second tent strap segment and the fourth tent strap segment, wherein each rod is longer than a straight distance from where each is coupled to the first tent strap segment and the third tent strap segment and from the second tent strap segment to the fourth tent strap segment, respectively, such that the rods have a double curvature when coupled to the tent strap segments to stretch the fabric, and further comprising a cross-strut that is supported in the intersection region of the rods to support the fabric, with the fabric also extending over the cross-strut, wherein the double curvature is such that on each side of the cross-strut, each rod curves outward toward its adjacent lateral edge and away from a straight line extending between the first tent strap segment and the third tent strap segment and from the second tent strap segment to the fourth tent strap segment, respectively.

2. The apparatus for providing protection against the sun as claimed in claim 1, wherein the ground strap segments intersect, and wherein the intersection region of rods that are curved in an arched manner and the intersection of the ground strap segments are disposed one above the other.

3. The apparatus for providing protection against the sun as claimed in claim 1, characterized in that additional straps on the lateral edge of the fabric are connectable to the rods by means of touch-and-close fasteners.

4. The apparatus for providing protection against the sun as claimed in claim 1, characterized in that the rods can comprise one or more parts.

5. The apparatus for providing protection against the sun as claimed in claim 1, characterized in that the rods are interconnectable in the intersection region.

6. The apparatus for providing protection against the sun as claimed in claim 5, characterized in that the cross-strut is connectable to the rods in the intersection region.

7. The apparatus for providing protection against the sun as claimed in claim 1, characterized in that the cross-strut is insertable into pockets on the lateral edge of the fabric.

8. An apparatus for providing protection against the sun, said apparatus comprising a rod assembly, first and second ground strap segments and a fabric that is stretchable over said rod assembly, wherein the fabric has two bottom longitudinal edges and two lateral longitudinal edges, wherein the rod assembly comprises two intersecting, resilient individual rods that intersect at only a single location, which, in the position of use, are coupled to ends of the first and second ground strap segments, the rods being curved in an arched manner, and further comprising a cross-strut is supported in an intersection region of the individual rods to support the fabric, with the fabric extending over the cross-strut, and further comprising first and second tent strap segments extending from one of the longitudinal edges and third and fourth tent strap segments extending from the other longitudinal edge, with the first and second tent strap segments being coupled to one of the ends of the rods and the third and fourth tent strap segments being coupled to opposite ends of the rods, with the fabric being stretched over the rods, and with the rods extending diagonally across the fabric between the first tent strap segment and the third tent strap segment, and between the second tent strap segment and the fourth tent strap segment, respectively, and further comprising connectors for further securing the individual rods to the fabric, wherein each rod is longer than a straight distance from where each is coupled to the first tent strap segment and the third tent strap segment and from the second tent strap segment to the fourth tent strap segment, respectively, such that the rods have a double curvature when coupled to the tent strap segments to stretch the fabric, wherein the fabric continuously contacts both of the rods as it stretches over the rods and the intersection region, and wherein the fabric also extends over and contacts the cross-strut such that both the rods and the cross-strut contact the fabric and provide a structural framework to support the fabric as it is stretched over the rod assembly and the cross-strut, whereby the fabric provides a covering to protect against the sun without the need for an inner tent positioned beneath the fabric, wherein the double curvature is such that on each side of the cross-strut, each rod curves outward toward its adjacent lateral longitudinal edge and away from a straight line extending between the first tent strap segment and the third tent strap segment and from the second tent strap segment to the fourth tent strap segment, respectively.

9. The apparatus for providing protection against the sun as claimed in claim 8, characterized in that, for transporting purposes, the individual rods each comprise a plurality of rod parts that can be fitted together, two adjacent rod parts being interconnected by means of resilient ties.

10. The apparatus for providing protection against the sun as claimed in claim 8, wherein the apparatus has two opposing narrow sides and two opposing wide sides, and characterized in that the two adjacent individual rods on the narrow sides of the apparatus for providing protection against the sun are each retained by means of at least one connecting strut, wherein the connecting struts are clipped onto the individual rods by means of retaining elements that are provided at the ends of said connecting struts.

11. The apparatus for providing protection against the sun as claimed in claim 8, characterized in that the individual rods are interconnected in the intersection region.

12. The apparatus for providing protection against the sun as claimed in claim 11, characterized in that a molded part is provided in the intersection region of the individual rods, said molded part comprising two intersecting tubular sections, continuous elongated slots being provided in the open sides of said tubular sections remote from one another, and the molded part being clipped to the individual rods by means of the elongated slots.

13. The apparatus for providing protection against the sun as claimed in claim 8, characterized in that the cross-strut is connected to the individual rods or to the molded part in the intersection region.

14. The apparatus for providing protection against the sun as claimed in claim 8, characterized in that the cross-strut is inserted into pockets on the lateral longitudinal edge of the fabric.

15. The apparatus for providing protection against the sun as claimed in claim 8, characterized in that the cross-strut is sewn into a pocket that extends from one lateral longitudinal edge of the fabric to the other lateral longitudinal edge of the fabric.

16. An apparatus for providing protection against the sun, said apparatus comprising:

a rod assembly comprising two bendable intersecting rods that intersect at only a single location at an intersection region;

a fabric that is stretchable over said rod assembly, with the rods extending diagonally across the fabric;

two ground strap segments that are adapted to be placed on a floor, wherein each of the two ground strap segments has two opposing ends;

wherein each of the rods can be braced in an arched manner over the two ground strap segments by coupling ends of the rods to ends of the two ground strap segments, with the rod ends being subjected to tensile stressing, and each having a double curvature;

wherein the rods when braced in an arched manner define a structure with a longitudinal direction and lateral direction, with the longitudinal direction being greater than the lateral direction; and a cross-strut that is supported in the intersection region of the rods to support the fabric, with the fabric being positioned over the cross-strut;

wherein the fabric continuously contacts both of the rods as it stretches over the rods and the intersection region, and wherein the fabric also extends over and contacts the cross-strut such that both the rods and the cross-strut contact the fabric and provide a structural framework to support the fabric as it is stretched over the rod assembly and the cross-strut, whereby the fabric provides a covering to protect against the sun without the need for an inner tent positioned beneath the fabric, wherein the double curvature is such that on each side of the cross-strut, each rod curves outward toward an adjacent edge of the fabric and away from a straight line extending between diagonally positioned corners of the fabric.

* * * * *